US005584200A

United States Patent [19]

Andersen

[11] Patent Number: 5,584,200

[45] Date of Patent: Dec. 17, 1996

[54] UNIVERSAL CRIMPING TOOL LOCATOR

[75] Inventor: Glenn W. Andersen, Salisbury, Md.

[73] Assignee: Grumman Aerospace Corporation, Los Angeles, Calif.

[21] Appl. No.: 336,172

[22] Filed: Nov. 8, 1994

[51] Int. Cl.[6] ..... H01R 43/042

[52] U.S. Cl. ..... 72/31.12; 72/409.14; 72/461

[58] Field of Search ..... 72/410, 409, 461, 72/36, 35, 31.12, 409.14; 29/751, 753, 721

[56] References Cited

U.S. PATENT DOCUMENTS

| | | | |
|---|---|---|---|
| 2,753,742 | 7/1956 | Buchanan | 72/410 |
| 3,028,776 | 4/1962 | Keller | 72/410 |
| 3,049,951 | 8/1962 | Rensink | 72/402 |
| 3,094,702 | 6/1963 | Ustin et al. | 1/220 |
| 3,142,209 | 7/1964 | Demler | 81/15 |
| 3,199,334 | 8/1965 | Holmes | 72/410 |
| 3,199,335 | 8/1965 | Holmes et al. | 72/410 |
| 3,252,316 | 5/1966 | Haucke | 72/402 |
| 3,345,856 | 10/1967 | Werner et al. | 72/410 |
| 3,487,524 | 1/1970 | Filia | 29/203 |
| 3,504,417 | 4/1970 | Filia | 29/203 |
| 3,673,848 | 4/1972 | Filia | 72/410 |
| 3,706,121 | 12/1972 | Gillespie | 29/203 |
| 3,710,611 | 1/1973 | Filia | 72/410 |
| 3,713,322 | 1/1973 | Fischer | 72/410 |
| 3,738,150 | 6/1973 | Holmes et al. | 72/410 |
| 3,751,963 | 8/1973 | Munshower et al. | 72/410 |
| 4,179,956 | 12/1979 | Gooley | 81/9.5 |
| 4,420,890 | 12/1983 | Naylor | 72/36 |
| 4,630,462 | 12/1986 | Wiener et al. | 72/410 |
| 4,637,242 | 1/1987 | Undin et al. | 72/410 |
| 4,719,789 | 1/1988 | Wiebe et al. | 72/410 |
| 4,932,237 | 6/1990 | Hatfield | 72/452 |
| 4,934,204 | 6/1990 | Hadden | 72/410 |
| 4,974,314 | 12/1990 | Nickerson et al. | 29/751 |
| 4,982,594 | 1/1991 | Wiebe | 72/416 |
| 5,230,129 | 7/1993 | Scruggs | 29/267 |

FOREIGN PATENT DOCUMENTS

| | | | |
|---|---|---|---|
| 585535 | 2/1947 | United Kingdom | 72/410 |

*Primary Examiner*—Daniel C. Crane

*Attorney, Agent, or Firm*—Terry J. Anderson; Karl J. Hoch, Jr.

[57] ABSTRACT

A universal crimping tool locator which is adapted to accurately and repeatedly accommodate and locate all sizes of electrical contacts in a crimping tool within the crimping range of a specific crimping tool frame. The inventive universal crimping tool locator integrates a plurality of concepts in that a multi-stepped receptacle tip of the locator is adapted to accommodate different sizes of electrical contacts and is in operative communication with a measuring device, preferably such as a micrometer head, so as to derive a single crimping tool arrangement or frame which contemplates the provision of a controllable, functionally highly predictable and reliable structure for enabling the crimping of widely divergingly sized electrical contact and wire combination, and which is designed for any particular crimping tool frame with which the crimping tool locator is intended to be employed.

4 Claims, 1 Drawing Sheet

UNIVERSAL CRIMPING TOOL LOCATOR

BACKGROUND OF THE INVENTION

1. Field of the Invention

The present invention relates to a crimping tool locator and, more particularly pertains to a universal crimping tool locator which is adapted to accurately and repeatedly accommodate and locate all sizes of electrical contacts in a crimping tool within the crimping range of a specific crimping tool frame.

The utilization of crimping tools which are specifically designed to provide appropriate interconnections between electrical contacts or terminals and the stripped ends of normally sheathed or insulated electrical wires, and in which the electrical contacts are crimped to constitute electrically conductive and clamped connections with the wire ends in a substantially permanent and specifically arranged manner, is widely known in the electrical wiring technology. Crimping tools of many kinds for effecting interconnections between electrical contacts and electrical wires have been developed to high degrees of sophistication in industry, such tools ranging from simple hand tools of the type in which manual exertion is employed for squeezing the barrel portion of a contact onto the stripped end of a wire disposed therein, to the provision of complex crimping tool frames which may be designed to accommodate a large number of specific, diversely sized crimping tool locators in order to be able to effectuate the interconnections between a wide range of complementary electrical contact and wire sizes.

In order to properly position or, in essence, be able to determine the relative positioning of the electrical contacts and therewith associated stripped electrical wire ends in the appropriate crimping tool or crimping tool frame, there have been developed suitable crimping tool locators, in which the respectively employed crimping tool locator is specifically adapted to properly position the applicable electrical contact in the crimping tool or tool frame such that the indentors or the components providing the crimping action are located in the appropriate position relative to the contact, thereby enabling the formation of a reliable electrical interconnection between the contact and the therewith associated wire.

Inasmuch as the sizes or dimensions of electrical contacts and associated electrical wires which are to be connected thereto may vary over a considerable range, an individual crimping tool frame may of necessity require the stocking of considerable numbers of individual crimping tool locators so as to be able to facilitate the locating of the full range of electrical connectors or contacts and associated wires in the crimping tool. The requirement for having to provide a multiplicity of different or diverse crimping tool locators for use with a single crimping tool frame or device to facilitate the positioning of the crimping tool, which is associated therewith, entails an extremely complex and expensive mode of operation. In particular, it is frequently necessary to provide large numbers of diverse crimping tool locators, which necessitates a considerable financial expenditure, and moreover it may be physically impractical to carry every available crimping tool locator to every specific job site or to stock every development or research laboratory and facility with a full complement of electrical contact and wire crimping tooling. Moreover, at times it may not even be feasible to stock a full range of crimping tool locators which are adapted to be associated with a specific crimping tool frame or device, resultingly leading to possible operating downtime and the inconvenience in having to search for an obtain the appropriate crimping tool locator. In addition to the foregoing, such a need for having to provide a large number of different crimping tool locators may possibly lead to the expense of including crimping tool locators which may only be required for specific or limited applications, thereby again increasing the cost of tooling in having to stock such underutilized infrequently employed components.

2. Discussion of the Prior Art

In essence, crimping tool locators which are currently employed in the electrical industry and technology related to the interconnection of electrical contacts and wires, and which are associated with various types of crimping tools or frames, are basically subject to the limitations as discussed hereinabove.

Nickerson et al. U.S. Pat. No. 4,974,314 disclose a crimping tool wherein a spring-loaded crimping contact locator is adapted to be positioned therein in order to facilitate locating the stripped end of an electrical wire in specific relationship with an electrical contact which is to be crimped thereover. There is no disclosure of utilizing a universal crimping tool locator as contemplated pursuant to the present invention, wherein a single universal crimping tool locator is adapted to locate a wide range of differently dimensioned electrical contacts and wires in a crimping tool arrangement.

Undin et al. U.S. Pat. No. 4,637,242 disclose a locator device for a crimping tool which is also directed to be utilized primarily with a single size of electrical contacts and wire for cable shoes.

Demler U.S. Pat. No. 3,142,209 discloses a crimping tool locator which is primarily utilized for the purpose of locating a single size of an electrical contact adapted to and clampingly joined to a specific wire size.

Filia U.S. Pat. No. 3,710,611 discloses a terminal locator for a crimping tool which is also designed primarily for locating and positioning a particularly sized electrical contact and wire component in the crimping tool.

Munshower et al. U.S. Pat. No. 3,751,963 disclose a crimping tool providing for crimping adjustment between electrical contacts and wires, but does not disclose a full range of crimping tool locations to enable differently sized electrical contacts to be accommodated in the crimping tool to the extent provided for by the inventive universal crimping tool locator.

Holmes et al. U.S. Pat. No. 3,738,150 disclose a turret head assembly for a crimping tool which is designed to accommodate differently dimensioned and positioned electrical contacts and locating these in the crimping tool for crimping engagement with electrical wires. However, only a limited number of different crimping tool adjustments are possible with this particular turret head construction.

Filia U.S. Pat. No. 3,673,848 discloses a crimping tool adjustment device for locating and positioning an electrical terminal element in a crimping tool in proper relationship with tool dies. There is no disclosure of a universal crimping tool providing for the locating of variously sized electrical contacts and wires in crimping tool assemblies or frames over a wide range of wire and contact dimensions.

SUMMARY OF THE INVENTION

Accordingly, pursuant to the present invention, there is provided a novel and unique universal crimping tool locator which is adapted to be operatively associated with a crimping tool frame so as to accurately accommodate and locate all sizes of electrical contacts within the full crimping range of the specific tool frame, and within a particular tooling type renders itself available to accommodate in a single crimping tool locator the dimensions of different types and sizes of locators which are ordinarily consistent from crimping tool locator to locator. Generally, these dimensions are those associated with the crimping tool locator and crimping tooling interface and are generally associated with the individual bore of the locator tips and the depth to which the electrical contact is recessed within the bore.

In essence, the inventive universal crimping tool locator advantageously integrates a plurality of concepts in that a multi-stepped receptacle tip of the locator is adapted to accommodate different sizes of electrical contacts and is in operative communication with a measuring device, preferably such as a micrometer head, so as to derive a single crimping tool arrangement or frame which contemplates the provision of a controllable, functionally highly predictable and reliable structure for enabling the crimping of widely divergingly sized electrical contact and wire combination, and which is designed for any particular crimping tool frame with which the crimping tool locator is intended to be employed.

Through the intermediary of the inventive universal crimping tool locator, it becomes possible through the intermediary of a single crimping tool locator to practically always be assured of having the correct crimping tool for the particular contact and wire crimping job at hand and which is capable of producing a reliable electrical and mechanical interconnection between the electrical contact and the associated wire end consistent with the most demanding industrial and technological electrical specifications.

The measuring device or micrometer head of the crimping tool locator may have a digital display arranged thereon so as to readily enable a rapid and precise reading out of the values of the various sizes of associated electrical contacts and wire which are to be accommodated by the crimping tool. Moreover, the tip portion of the crimping tool locator accommodating the electrical component which is to be crimped may be replaceable by another tip portion in the interface with the crimping tool frame so as to enable extending the range of usefulness thereof by accommodating electrical contact sizes and types which have not yet been designed but may, in the future, possibly be employed with the crimping tool device. Moreover, it may also be advantageous to provide two or more types of step-indexed tips for the crimping tool locator in which the tips may be color coded and identifiable through suitable numerical or the like tables correlating the correct crimping tool locator and micrometer settings, along with the customary indentor adjustment settings for different wire gauges, as is known in the technology. A simple card setting forth the information in tabular format, and which may be attached to each crimping tool, may provide an operator with all of the information required in order to be able to crimp any electrical contact on any wire gauge within the limits of the tool frame employed, and to produce a crimp which is identical with that produced with so-called "hard tooling"; in effect, specific crimping tool which is designed for a single or specialized purpose.

The universal crimping tool locator may essentially replace, by means of a single locator, a wide range and variety of individual crimping tool locators which have heretofore been operatively associated with a specific crimping tool frame or device.

Accordingly, it is a primary object of the invention to provide a universal crimping tool locator which is adapted to locate a wide range of differently dimensioned electrical contacts and associated wire ends in a crimping tool frame.

Another object of the present invention is to provide a universal crimping tool locator as described herein wherein the locator is replaceably positioned in interfacing connection with a crimping tool frame so as to be readily replaceable by a different type of universal crimping tool locator.

Yet another object of the present invention is to provide a universal crimping tool locator which includes a measuring device for calibrating a wide range of electrical contacts and associated wire ends adapted to be joined together in a specific crimping tool.

BRIEF DESCRIPTION OF THE DRAWINGS

Reference may now be had to the following detailed description of an exemplary embodiment of a universal crimping tool locator constructed pursuant to the invention, taken in conjunction with the accompanying drawings; in which.

DETAILED DESCRIPTION OF A PREFERRED EMBODIMENT

Figure 2:
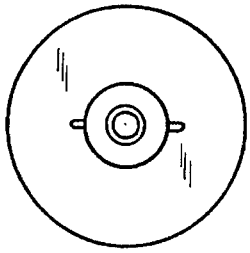
FIG. 2 illustrates a front end view of the crimping tool locator of FIG. 1.
Figure 1:
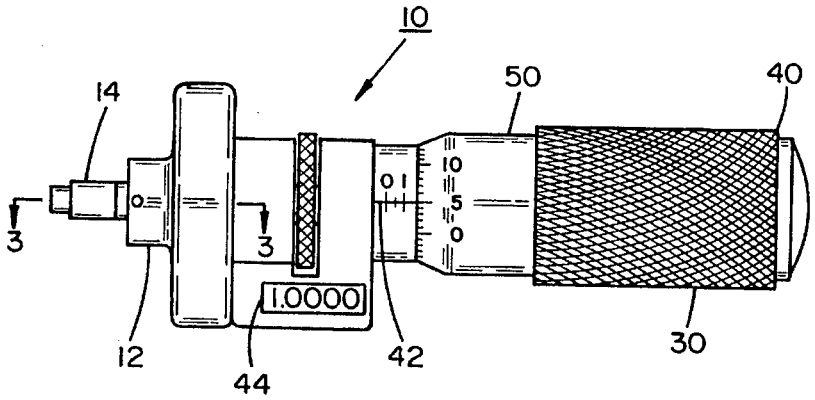
FIG. 1 illustrates a longitudinally axial side view of a universal crimping tool locator pursuant to the present invention.
Figure 3:
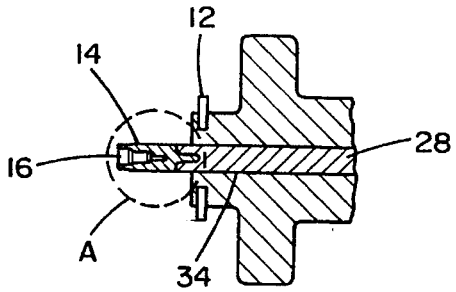
FIG. 3 illustrates a fragmentary sectional view through the end portion of the crimping tool locator taken along line 3—3 in FIG. 1.
Figure 4:
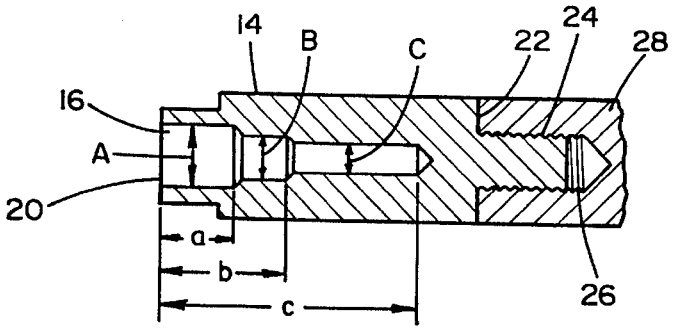
FIG. 4 illustrates, on an enlarged scale, the encircled portion A in FIG. 3 of the drawings.

Referring now in detail to the drawings, specifically to FIGS. 1 and 2, there is illustrated the inventive universal crimping tool locator 10. The crimping tool locator 10 includes an interfacing structure 12 which is adapted to enable mounting the crimping tool locator 10 on a suitable crimping tool frame or device (not shown), the latter of which is basically known per se in this technology. The crimping tool locator 10 includes a replaceable universal crimping tool head end 14 which includes a recess or bore 16, as shown in detail in FIGS. 3 and 4 having stepped diameter portions for receiving respectively different electrical contact sizes, in this instance, by way of example only, wherein the dimension 'A' of the largest contact size may be 0.081 inch in diameter; the dimension 'B' of the second contact size 0.065 inch in diameter; and that of the third dimension 'C' which is for the smallest contact size 0.045 inch in diameter.

The depth 'a' of the largest diameter recess or bore A as measured from the leading or tip end 20 of the replaceable universal crimping tool locator 10; for example, 0.100 inch; the depth 'b' from the tip for the intermediate or second bore size 'B' may be 0.170 inch; and the depth 'c' of the bore 'C' to the bottom end about 0.360 inch from the tip end 20 of the crimping tool locator. However, these bore and depth dimensions are only set forth by way of example, and numerous other sizes may also be contemplated within the scope of the invention, including a greater number of steps rather than the three as illustrated herein.

Although the foregoing dimensions of the crimping tool locator tip or head end portion 14 basically accommodate all of the M39029 BIN Code electrical contacts which are normally crimped by the Grumman Aerospace Corporation employing the AFM8 (M225012) crimping tool, other multi-step locator head ends can be readily fabricated for other types and sizes of crimping tools or new electrical contact sizes.

The end 22 of the crimping tool locator head end portion 14 which extends into the locator interface 12 includes a screw threaded axial extension 24 which is threadingly engageable with an internally screw threaded bore 26 in a spindle 28 or a measuring device 30, such as a micrometer, so as to be secured against relative rotation therewith by the interengagement of the screw threads 24 and 26.

Shown connected to the spindle 28, or integral therewith, and extending opposite the direction of the universal crimping tool locator head end portion 14 within a bore 34 in the interfacing structure 12 for the crimping tool frame, is the measuring device 30, in this instance a micrometer. A micrometer head portion 40 possesses a suitable calibrating scale 42 for providing accurate dimensions in the calibration of the various electrical contact ends which are adapted to be inserted into the stepped bore of the crimping tool locator 10. As an optional feature the measuring device or micrometer 30 may be equipped with a digital readout or display 44 in order to render the use of the device simpler to an operator.

The universal crimping tool locator 10 can be fabricated by machining or otherwise forming the detail components such as the head end portion 14 which is associated with the interfacing of standard crimping tool locators with a standard crimping tool frame, and thereby creating a similar interfacing structure between the universal crimping tool locator and a commercial (or custom fabricated) measuring device 30, such as a commercially available micrometer head, for instance, as produced by the Starrett Corporation. The dimensions and tolerances of the standard crimping tool locator and tool frame interface are generally set forth in various specifications directed to the electrical interconnection between crimped electrical contacts and wires. Moreover, the universal step-indexed contactreceiving tip end 20 of the locator 10 is required to possess dimensions which are determined by an analysis of the electrical contact dimensions for which the crimping tool frame is designed in order to accommodate the foregoing. These dimensions are well known in this technology.

An operator would ordinarily install the universal crimping tool locator 10 in a respective crimping tool frame (not shown) in a manner as the traditional locator would be normally installed, employing the interfacing structure 12 and suitable external spring and locking elements (not shown for purposes of clarity). The operator would then normally look up the correct crimping tool locator and indentor settings in a manufacturers instructions for the type of electrical contact and wire which are to be joined. These instructional tables can be simply augmented by providing a micrometer setting at the calibrating scale 42 in lieu of the specific crimping tool locator part number, and irrespective as to whether the operator employs the inventive universal crimping tool locator 10 or so-called hard tooling, the crimping operation will produce identical crimp qualities.

From the foregoing, it becomes readily apparent that the universal crimping tool locator is adapted to provide for the locating of various widely differing electrical contacts being crimped to wire ends in a single crimping tool frame, thereby eliminating the necessity for the provision of numerous and expensive separate crimping tool locators; and rendering the entire structure simple and inexpensive to manufacture and maintain. Although initial costs for each universal crimping tool locator 10 may be somewhat higher than currently employed locators, the broad range and universality in the application thereof reduces the need for large quantities of separate locators for different contact sizes and types, thereby lowering overall costs while increasing efficiencies in use.

Furthermore, instead of a micrometer 30, illustrated with an analog handle or head 50, as in FIG. 1, other positive measuring devices can also be employed. Among these there may be digital micrometers, vernier slides, dial-indicating slides, stepper motors, and the like.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A crimping tool locator for locating and supporting an electrical contact having a crimpable wire receiving portion and terminal end relative to crimping tool means, said crimping tool locator comprising:

a) locating means for selectively supporting a plurality of differently sized contacts, said locating means comprising an elongate member having a bore longitudinally extending therein for receiving an electrical contact, said locating means being interchangeable with other locating means accommodating electrical contacts of different types and sizes, said bore having portions of varying diameters for the positioning of differently sized contacts, said bore portions forming a stepped configuration of sequentially smaller diameters extending into said locating means;

b) measuring means having a calibration scale operatively connected to said locating means for calibrating and adjusting crimping means for correlating a range of wire sizes with a selected one of said contacts, said elongate member comprising a cylindrical body inserted into a bore formed in said measuring means, said cylindrical body including a coaxially projecting screw threaded element extending into said bore for engagement with a screw threaded portion of said bore, said cylindrical body being detachable fastened to said measuring means; and c) an interface facilitating positioning of said locator on a crimping tool frame.

2. A crimping tool locator as claimed in claim 1, wherein said measuring means comprises a micrometer.

3. A crimping tool locator as claimed in claim 2, wherein said micrometer includes a micrometer head with the calibration scale being a vernier scale.

4. A crimping tool locator as claimed in claim 2, wherein said micrometer includes a digital display for a readout of calibration values.

* * * * *